United States Patent [19]

Steinwand

[11] 4,314,580

[45] Feb. 9, 1982

[54] FAUCET STRUCTURE

[76] Inventor: Dennis D. Steinwand, 201-6th Ave. N.W., Mandan, N. Dak. 58554

[21] Appl. No.: 157,884

[22] Filed: Jun. 9, 1980

[51] Int. Cl.[3] ..... F16L 5/00

[52] U.S. Cl. ..... 137/360; 137/312; 137/375

[58] Field of Search ..... 137/375, 312, 315, 360

[56] References Cited

U.S. PATENT DOCUMENTS

| | | | |
|---|---|---|---|
| 1,412,042 | 4/1922 | Coar | 137/360 |
| 2,625,173 | 1/1953 | Hodes, Jr. | 137/360 |
| 2,652,224 | 9/1953 | Noland | 137/360 |
| 2,810,395 | 10/1957 | Simmons | 137/360 |
| 3,267,956 | 8/1966 | Kline | 137/360 |
| 4,158,366 | 6/1979 | Van Meter | 137/360 |

*Primary Examiner*—A. Michael Chambers

*Attorney, Agent, or Firm*—Merchant, Gould, Smith, Edell, Welter & Schmidt

[57] ABSTRACT

A freeze-resistant sill cock comprising a housing having an inlet for connection within a house to the water supply of the house, a linear having an outlet tap to extend outside the house, the linear being removably sealed within the end of the housing, valving mechanism at the inlet for controlling flow of water therefrom into the liner, and an actuator extending through the liner and the outlet tap for enabling operation of the valving mechanism from without the house.

7 Claims, 5 Drawing Figures

FAUCET STRUCTURE

TECHNICAL FIELD

This invention relates to the field of plumbing fixtures, and particularly to a faucet or sill cock structure, for use in buildings located in cold climates, in which structure inadvertent freezing of water in the faucet does not result in water damage to the building, and can be repaired by a simple replacement procedure without any but the simplest tools.

BACKGROUND OF THE PRIOR ART

The problem of freezing sill cocks has been recognized for some time, and the conventional solution has been to position the actual valving mechanism of the cock sufficiently far within a building that building heat prevents freezing, the actuating mechanism to accomplish the valving being extended, for access from outside the building, through the feed conduit for conducting water so valved to the outside. Arrangements of this sort are successful if no water is allowed to remain in the feed conduit. Very often, however, a hose is connected to the sill cock, and the flow of water is shut off first at the hose nozzle and only then at the sill cock, leaving water not only in the hose, where its inadvertent freezing can do little damage, but also in the feed conduit. As a result the feed conduit can freeze and crack or burst, enabling leakage of water through the crack into the partition or basement of the house, and requiring that the water supply to the cock be cut off and a replacement conduit cut and fitted.

BRIEF SUMMARY OF THE INVENTION

In the present invention the conduit from the valving mechanism to the sill cock comprises an outer housing and an inner liner removable therefrom, normally sealed with respect thereto at its inner end and carrying the normal hose connection at its outer end. Operation of the valving mechanism admits water to the liner, to flow out at the hose connection, and operation of the valve mechanism is by an actuator passing axially through the liner and the housing. In the case of freezing, it is the liner which is burst or cracked, and any leakage is contained within the housing. To correct the damage it is only necessary to withdraw the liner from the housing and substitute a replacement. During this time the flow of water remains shut off at the valving mechanism, which need not be disturbed, and the general water supply in the building need not be turned off. No cutting and fitting of pipe is necessary for the repair of the faucet, which can be done by the building owner himself with no more tools than a screwdriver and possibly a hammer.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention. In the drawing like reference numerals indicate corresponding parts throughout the several views.

DESCRIPTION OF THE PREFERRED EMBODIMENT

Figures 1, 2, 3, 5:
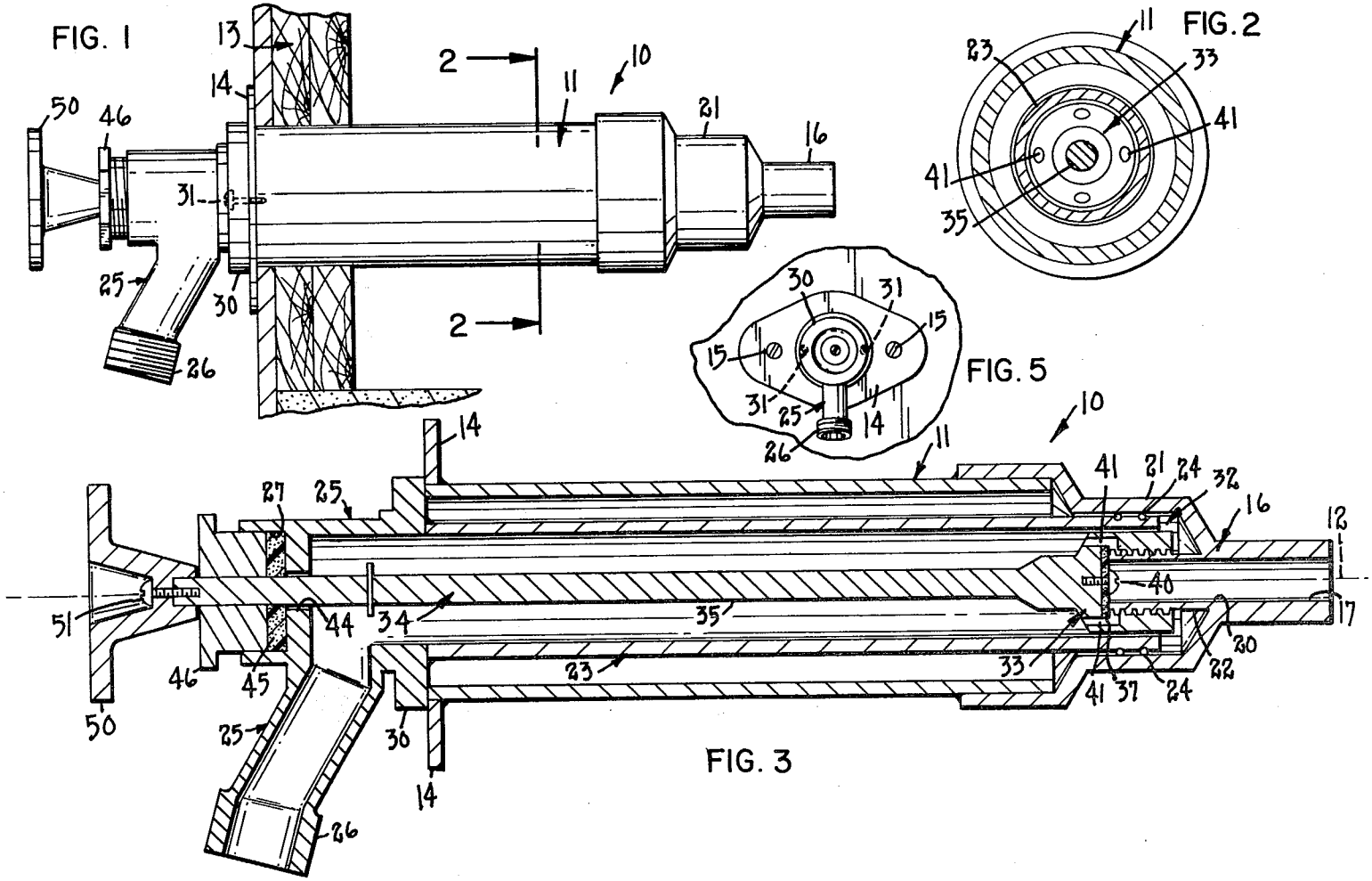
FIG. 1 is a side elevation of a faucet or sill cock according to the invention.
FIG. 2 is a transverse section taken along the line 2—2 of FIG. 1.
FIG. 3 is an axial longitudinal section of the faucet.
FIG. 5 is an end view of the faucet installed.
Figure 4:
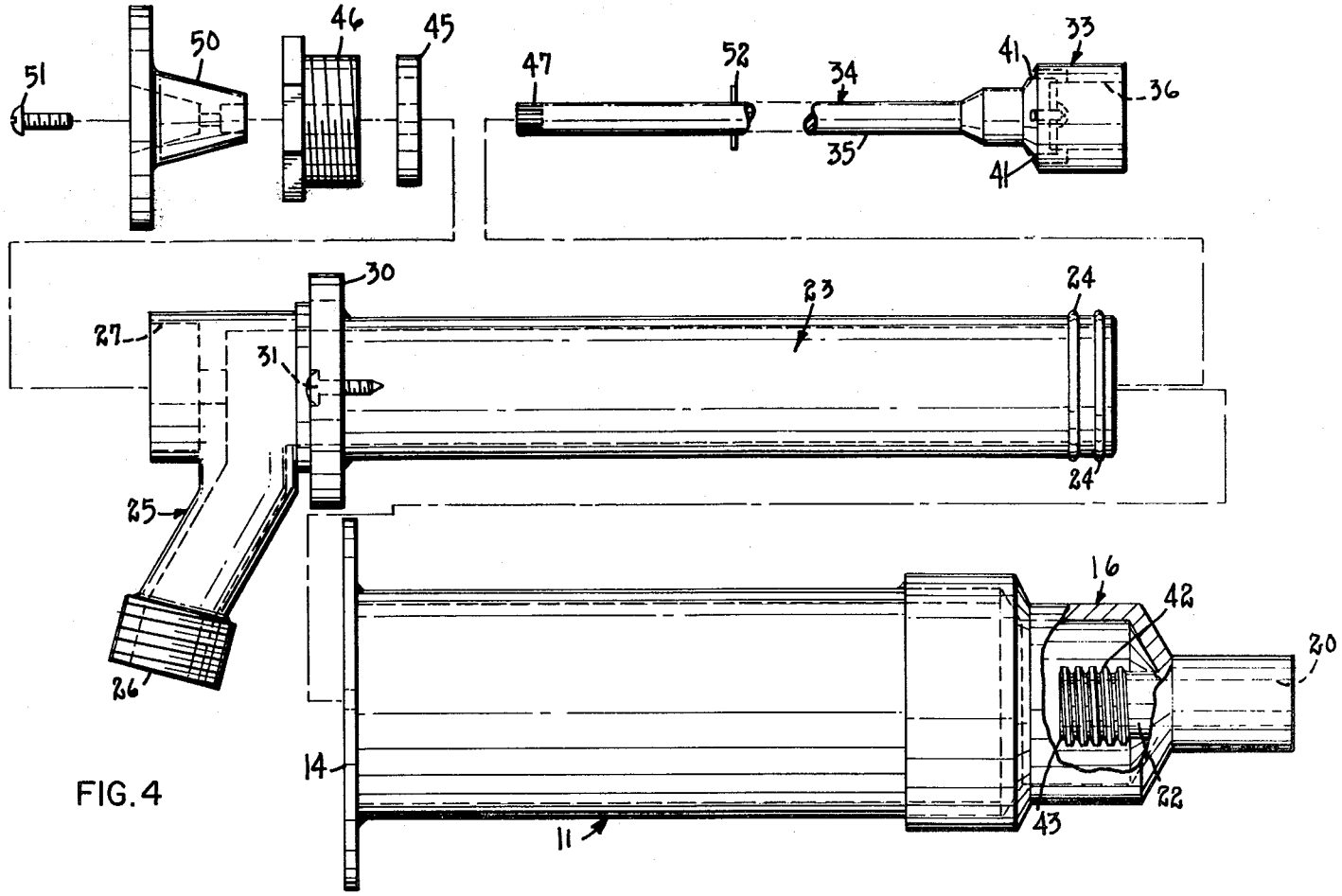
FIG. 4 is an exploded view of the faucet.

My faucet 10 is shown to comprise a hollow housing 11 extending along an axis 12 from a first end outside the wall 13 of the building to a second end within the building wall. At its outer end housing 11 includes means 14, in the form of a mounting plate, for securing the faucet in the wall 13, as by screws 15. At its inner end housing 11 includes inlet means 16 for connection to the water supply of the building, as by a sweated or threaded connection 17 in a bore 20.

Inlet means 16 has an internally smooth enlargement 21 surrounding and spaced from an inwardly projecting spud 22 through which bore 20 continues. A liner 23 coaxial with housing 11 but of smaller diameter has an inner end carrying O rings 24 to make a watertight seal between the liner and enlargement 21. At its outer end liner 23 carries or is integral with an outlet tap 25 including a hose connection 26, a packing chamber 27, and a mounting plate 30 for securement to plate 14 of housing 11 as by screws 31. At their outer ends the inside diameter of housing 11 is considerably greater than the outside diameter of liner 23.

Faucet 10 includes a valving mechanism 32 comprising a seal member including spud 22 and a closure member including an enlarged head 33 at the inner end of an actuator 34 having a shaft 35 which passes axially through liner 23 and housing 11. Head 33 has an internally threaded axial bore 36, at the bottom of which a closure or washer 37 is secured as by a screw 40. A plurality of passages 41 extend outwardly through head 33 into liner 23. Spud 22 is externally threaded at 42 to mate with head 33. The inner end of spud 22 is formed as an annular seat 43 for engagement by washer 37.

At its outer end shaft 35 passes axially through an aperture 44 in outlet tap 25, and through a packing 45 and gland 46. It terminates outwardly in a configuration 47 adapted to receive a mating configuration in a handle 50, which is secured thereto by a screw 51. If desired, a cross pin 52 may be provided in shaft 35 for limiting its outward movement by contact with tap 25.

OPERATION

It will be evident that when handle 50 is turned in a first direction, washer 37 is brought into engagement with seat 43, to prevent flow of water out of bore 20. When the handle is turned in the other direction, washer 37 is moved away from seat 43, enabling the flow of water from bore 20 through passages 41 into liner 23, and thence out of tap 25 at connection 26, but O rings 24 prevent the flow of water from liner 23 into housing 11.

In the absence of any connection at 26, any residual water normally drains from liner 23 at connection 26 when the valve mechanism is closed. However, if, for example, a hose connected at 26 is turned off at its nozzle before the valve mechanism is closed, the hose and liner 23 remain full of water, and if the ambient temperature drops suddenly, freezing make take place, even to the extent of cracking or bursting liner 23. However, the liner is surrounded by housing 11: any water resulting from subsequent thawing is contained between the liner and housing, so that no water damage occurs in the building.

To repair the faucet—only liner 23 of which is damaged—screw 51 and handle 50 are removed, screws 31 are also removed, and gland 46 is removed or loosened. If the ice in liner 23 had melted, the liner can now simply be drawn out through the housing, leaving actuator 34 in position so that flow of water from bore 20 is prevented. If ice still holds liner 23 with respect to actuator 35, there remains enough freedom between the outer ends of the housing and the liner to allow application of force laterally at tap 25 sufficient to shatter the ice enough to enable the liner to be drawn outwardly from the housing and the actuator, and be discarded. The tapered external configuration of head 23 facilitates this removal process.

Next a replacement liner is inserted into housing 11 around actuator shaft 35 and is secured in place by screws 31. A new packing 27 is preferably used, gland 46 is appropriately tightened, and handle 50 is reattached by screw 51.

It will be appreciated that sill cocks according to the invention can be made in any desired axial length, according to the wishes of the designer and the climate of the intended location of use, so that freezing of the water supply in bore 20 does not occur.

From the above it will be evident that the invention comprises a faucet or sill cock structure in which freeze damage does not occur unless water is allowed to remain in an outlet tap, in which cracking or bursting due to freezing does not result in water damage to the building, and in which repair can be made by the building owner with simple tools and without cutting off the water supply to the building.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A faucet structure comprising, in combination:

a hollow housing extending along an axis between first and second ends;

inlet means at said second end of said housing for coupling to a water supply conduit;

valving means at said second end actuable to selectively enable and prevent flow of water from said conduit into said housing;

a hollow liner removably contained within said housing along said axis between first and second ends;

an outlet tap closing said first end of said liner beyond said first end of said housing;

means at said second ends of said housing and said liner for releasably forming a watertight seal therebetween;

an actuator extending axially within said housing and said liner from a first end which sealingly traverses said outlet tap to a second end connected to said valving means, whereby to open said valving means enabling flow of water from said conduit, and to close said valving means to prevent flow of water from said conduit, said liner being removable through said first end of said housing over said actuator with the valving means closed thereby permitting replacement of said liner without enabling the flow of water from said conduit into said housing; and means normally retaining said liner in said housing.

2. A structure according to claim 1, wherein said outlet tap has an axial opening through which said actuator extends, and handle means are removably connected to said first end of said actuator means outside said outlet tap.

3. A structure according to claim 1 and means at said first end of said housing for securing said housing in a wall.

4. A faucet structure comprising, in combination:

a hollow housing extending along an axis between first and second ends;

inlet means at said second end of said housing for coupling to a water supply conduit;

valving means actuable to selectively enable and prevent flow of water from said conduit into said housing;

a removable hollow liner contained within said housing along said axis between first and second ends;

an outlet tap closing said first end of said liner beyond said first end of said housing;

means at said second ends of said housing and said liner for releasably forming a watertight seal therebetween;

an actuator extending axially within said housing and said liner from a first end which sealingly traverses an axial opening in said outlet tap to a second end connected to said valving means, whereby to open said valving means enabling flow of water from said conduit, and to close said valving means whereupon said liner may be withdrawn through said first end of said housing with said valving means closed without enabling the flow of water from said conduit into said housing;

means normally retaining said liner in said housing; and said valving means comprising a seat member in communication with said inlet means and projecting axially into said second end of said housing, and a closure member mounted on said second end of said actuator for axial valving cooperation with said seat member.

5. A structure according to claim 4 in which said closure member comprises an enlarged head having an internally threaded axial bore therein with a passage extending outwardly therefrom into said liner, and a closure mounted at the bottom of said bore.

6. A structure according to claim 4 in which said seat member includes an annular seat for axial engagement by said closure member to prevent flow of water from said inlet means into said liner, and in which said closure member comprises an enlarged head having an internally threaded axial bore therein with a passage extending outwardly therefrom into said liner, and a closure mounted at the bottom of said bore.

7. A faucet structure, comprising:

(a) a hollow elongated housing extending along an axis between first and second ends, said first end of said housing being open;

(b) inlet means at said second end of said housing for coupling to a water supply conduit;

(c) a replaceable hollow liner positioned within said housing along said axis between first and second ends so as to be coaxial with said housing, said hollow liner having a smaller outside diameter than an inside diameter of said housing so as to form an annular space between said liner and said housing, (d) an outlet tap attached at said first end of said liner beyond said first end of said housing for attachment of a hose or the like;

(e) valving means positioned at said second end of said housing actuable to selectively enable and prevent flow of water from said conduit into said liner;

(f) means at said second ends of said housing and said liner located between said liner and said housing for releasably forming a watertight seal therebetween to prevent the flow of water from said liner into said annular space;

(g) a shaft extending axially within said housing and said liner, said shaft having a first end which sealingly traverses said first end of said liner and is removably connected to a handle means and a second end which is connected to said valving means, said shaft cooperating with said handle means to selectively open said valving means enabling flow of water from said conduit and to selectively close said valving means to prevent the flow of water from said conduit, said shaft being retained in position within said housing by said second end of said shaft connected to said valving means, whereby said liner may be withdrawn through said first end of said housing axially along said shaft thereby leaving said shaft positioned within said housing and cooperating with said valving means to prevent the flow of water from said conduit into said housing when said liner is removed; and (h) means removably attached at said first end of said housing for normally retaining said liner in said housing, said retaining means being removable to allow removal of said liner through said first end of said housing and insertion of a replacement liner through said first end of said housing, said retaining means being capable of being reattached for retention of said replacement liner.

* * * * *

UNITED STATES PATENT AND TRADEMARK OFFICE

CERTIFICATE OF CORRECTION

PATENT NO. : 4,314,580

DATED : February 9, 1982

INVENTOR(S) : Dennis D. Steinwand

It is certified that error appears in the above—identified patent and that said Letters Patent is hereby corrected as shown below:

In the Abstract, line 3, "linear" should be --liner--;

In the Abstract, line 4, "linear" should be --liner--;

In the Abstract, line 5, "the end" should be --the inner end--

Column 2, line 33, after "23" insert --so as to form an annular space therebetween--.

Signed and Sealed this

***Twenty-second* Day of *June 1982***

[SEAL]

*Attest:*

GERALD J. MOSSINGHOFF

*Attesting Officer* *Commissioner of Patents and Trademarks*